US007974526B2

(12) United States Patent
Chu

(10) Patent No.: US 7,974,526 B2
(45) Date of Patent: Jul. 5, 2011

(54) OUTDOOR HEATER

(75) Inventor: Chak-Tong Chu, Yuen Long (HK)

(73) Assignee: Honor Tone, Ltd., Shatin, New Territories (HK)

( * ) Notice: Subject to any disclaimer, the term of this patent is extended or adjusted under 35 U.S.C. 154(b) by 725 days.

(21) Appl. No.: 12/034,676

(22) Filed: Feb. 21, 2008

(65) Prior Publication Data

US 2009/0214194 A1 Aug. 27, 2009

(51) Int. Cl.
*F21V 7/00* (2006.01)

(52) U.S. Cl. ..... 392/419

(58) Field of Classification Search ..... 392/419, 392/407–440

See application file for complete search history.

(56) References Cited

U.S. PATENT DOCUMENTS

| | | | | |
|---|---|---|---|---|
| 4,906,818 | A | 3/1990 | Lumpp et al. | |
| 5,300,098 | A | 4/1994 | Philipot | |
| 5,380,983 | A | 1/1995 | Cavada et al. | |
| 5,595,672 | A | 1/1997 | Sham et al. | |
| 5,621,198 | A | 4/1997 | Betend-Bon | |
| 5,805,767 | A * | 9/1998 | Jouas et al. | 392/373 |
| 5,941,699 | A | 8/1999 | Abele | |
| 6,038,786 | A | 3/2000 | Aisenberg et al. | |
| 6,091,888 | A * | 7/2000 | Jane et al. | 392/365 |
| 6,452,501 | B1 | 9/2002 | Tse et al. | |
| 2006/0201333 | A1 * | 9/2006 | Friel et al. | 99/372 |
| 2009/0214194 | A1 * | 8/2009 | Chu | 392/419 |

* cited by examiner

*Primary Examiner* — Daniel Robinson

(74) *Attorney, Agent, or Firm* — Patzik, Frank & Samotny Ltd.

(57) ABSTRACT

An electric radiant heater has a proximity sensor capable of detecting the presence of an object proximate the top surface of the heater's housing. The heater also has a temperature sensor capable of sensing ambient temperature proximate the top surface of the heater's housing. A microcontroller is coupled to the proximity and temperature sensors. Upon the detection of an object atop the heater's housing, the microcontroller determines if the temperature sensor's output is indicative of the presence of ice or snow. If so, a heating element of the heater is allowed to remain in operation. Otherwise, the detected object is considered to be potentially combustible material, and the heating element is switched off by the microcontroller.

15 Claims, 5 Drawing Sheets

OUTDOOR HEATER

FIELD OF INVENTION

The present invention relates, in general, to electric space heaters, and, specifically, to electric heaters for outdoor applications.

DESCRIPTION OF RELATED ART

In colder climates, it is often desirable to provide some heat to outdoor areas immediately outside and adjacent a building or structure. For example, with the advent of laws in many jurisdictions prohibiting indoor smoking in public buildings and private businesses, smokers are often required to go outdoors in order to smoke. Moreover, in residential settings, as well as restaurants with outdoor dining, it may be desirable to heat an outdoor area adjacent a home or business during the winter months. Accordingly, there is a need for space heater devices to provide heat to outdoor areas adjacent buildings or structures.

With any space heater, there is an associated risk of fire, should combustible materials come into contact with the housing of the heater, or be placed in close proximity to the heater, without any physical contact with the heater's housing. Users of space heaters are accordingly routinely advised not to place any combustible materials within several feet of the heater.

One type of outdoor space heater is the type intended for wall or ceiling mounting. In such heaters, some form of mounting bracket is typically provided so that the heater may be mounted to a wall or other vertical surface. Preferably, such heaters are mounted relatively high above the ground, reducing the likelihood that the heater will come in contact with combustible material. Mounting such heaters relatively high in the air also reduces the likelihood that persons may be burned by accidentally coming in contact with heater while it is in use.

There are, however, certain flammable hazards which are more likely to be encountered by outdoor heaters. For example, leaves, branches, or other combustible debris may potentially fall towards or be blown by winds towards the heater, and may potentially come to rest atop the heater. Moreover, birds may potentially nest proximate the heater, leaving combustible nesting materials atop the heater.

BRIEF SUMMARY OF INVENTION

An electric radiant heater has a proximity sensor capable of detecting the presence of an object proximate the top surface of the heater's housing. The heater also has a temperature sensor capable of sensing ambient temperature proximate the top surface of the heater's housing. A microcontroller is coupled to the proximity and temperature sensors. Upon the detection of an object atop the heater's housing, the microcontroller determines if the temperature sensor's output is indicative of the presence of ice or snow. If so, a heating element of the heater is allowed to remain in operation. Otherwise, the detected object is considered to be potentially combustible material, and the heating element is switched off by the microcontroller.

In a preferred embodiment, the electric heater apparatus includes a housing having a first surface. A heating element is provided, with at least a portion of the heating element being disposed within the housing. A proximity sensor is associated with the housing. The proximity sensor emits a signal indicative of a presence of an object proximate the first surface of the housing. A conductor of electrical power is provided. A switching device is disposed between the conductor of electrical power and the heating element. The switching device having a first mode wherein electrical power is coupled to the heating element and a second mode wherein electrical power is decoupled from the heating element. A processor is operatively coupled to the sensor and the switching device. The processor emits a signal changing the switching device between the first mode and the second mode in response to the signal emitted by the proximity sensor.

In one embodiment of the present invention, the proximity sensor comprises at least one infrared emitting device and an infrared receiving device. The at least one infrared emitting device preferably comprises a plurality of emitting devices, with at least one of the plurality of emitting devices being disposed on a first side of the infrared receiving device and at least another one of the plurality of emitting devices being disposed on a second side of the infrared receiving device. In another embodiment of the present invention, the proximity sensor comprises an ultrasonic transceiver.

The heater apparatus further includes a temperature sensor associated with the housing. The temperature sensor emits a signal indicative of ambient temperature proximate the first surface of the housing. Means, which may include software or firmware executed as instructions and associated data by the processor, are provided for changing the switching device to the second mode upon both the proximity sensor emitting a signal indicative of a presence of an object proximate the first surface of the housing and the temperature sensor emitting a signal indicative of ambient temperature above a predetermined temperature threshold. In a preferred embodiment, the predetermined temperature threshold is approximately 1° Celsius.

The heater apparatus also includes at least one signaling device operatively coupled to the processor and providing an indication of the switching device transitioning from the first mode to the second mode. The at least one signaling device preferably comprises at least one light emitting diode.

The heater apparatus also includes a fault detection circuit operatively coupled to the proximity sensor. The fault detection circuit preferably includes both a short circuit detection circuit and an open circuit detection circuit.

The present invention also comprises a method of operating an electric heater apparatus. An electric heater apparatus is obtained, having the general construction discussed above. The switching device between the first mode and the second mode is then changed in response to the signal emitted by the proximity sensor. Moreover, this step of changing the switching device between the first mode and the second mode in response to the signal emitted by the proximity sensor may comprise changing the switching device to the second mode upon both the proximity sensor emitting a signal indicative of a presence of an object proximate the first surface of the housing and the temperature sensor emitting a signal indicative of ambient temperature above a predetermined temperature threshold. In a preferred embodiment, the predetermined temperature threshold is approximately 1° Celsius.

The method of operating an electric heater apparatus may further include the step of testing at least a portion of the proximity sensor for a fault condition. The fault condition may be an open circuit fault, a short circuit fault, or both types of fault conditions.

DETAILED DESCRIPTION OF INVENTION

Figure 1:
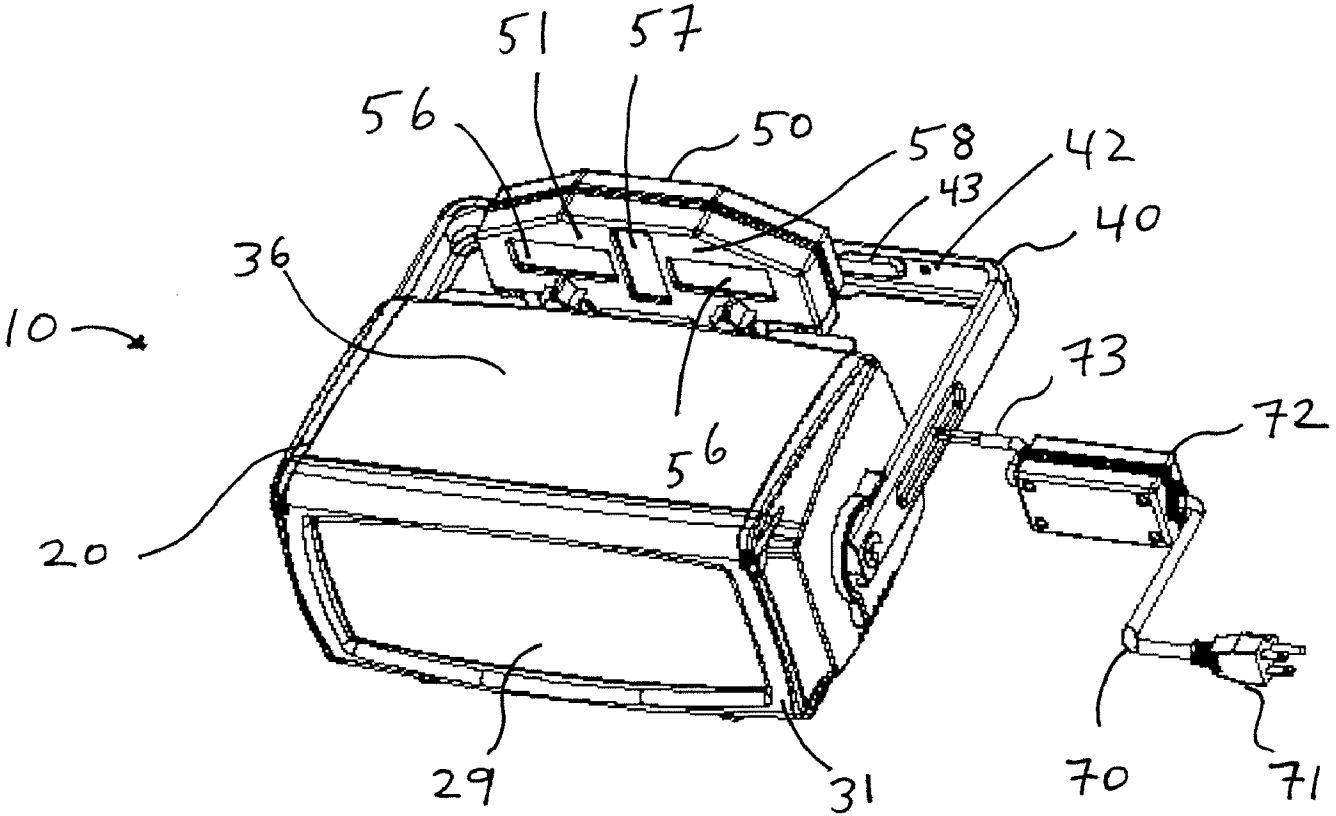
FIG. 1 is an elevated perspective view of the present heater apparatus.

The present outdoor heater apparatus 10 is shown in FIG. 1 as comprising main housing 20, mounting bracket 40, electronics housing 50, first power cord 70, second power cord 73, and switch box 72 disposed between the first and second power cords. Second power cord 73 delivers alternating current (AC) electrical power to a heating element within main housing 20, and to a direct current (DC) electrical power supply within electronics housing 50. Power plug 71 couples first power cord 70 to a source of AC power. For 110-120 volt 60 Hertz AC applications in the United States, a conventional, 3-prong NEMA 5 power plug is provided. Different plug configurations may alternatively be provided for AC power connection applications in other countries. Switch box 72 contains a switch, such as a rocker switch (not shown), for electrically coupling and uncoupling first power cord 70 and second power cord 73 to, in turn, power and unpower outdoor heater apparatus 10, respectively. Since the present apparatus in intended for outdoor use, the rocker switch is preferably shielded from the external environment with a shield or cover of silicone elastomer or other resilient material.

Figure 2:
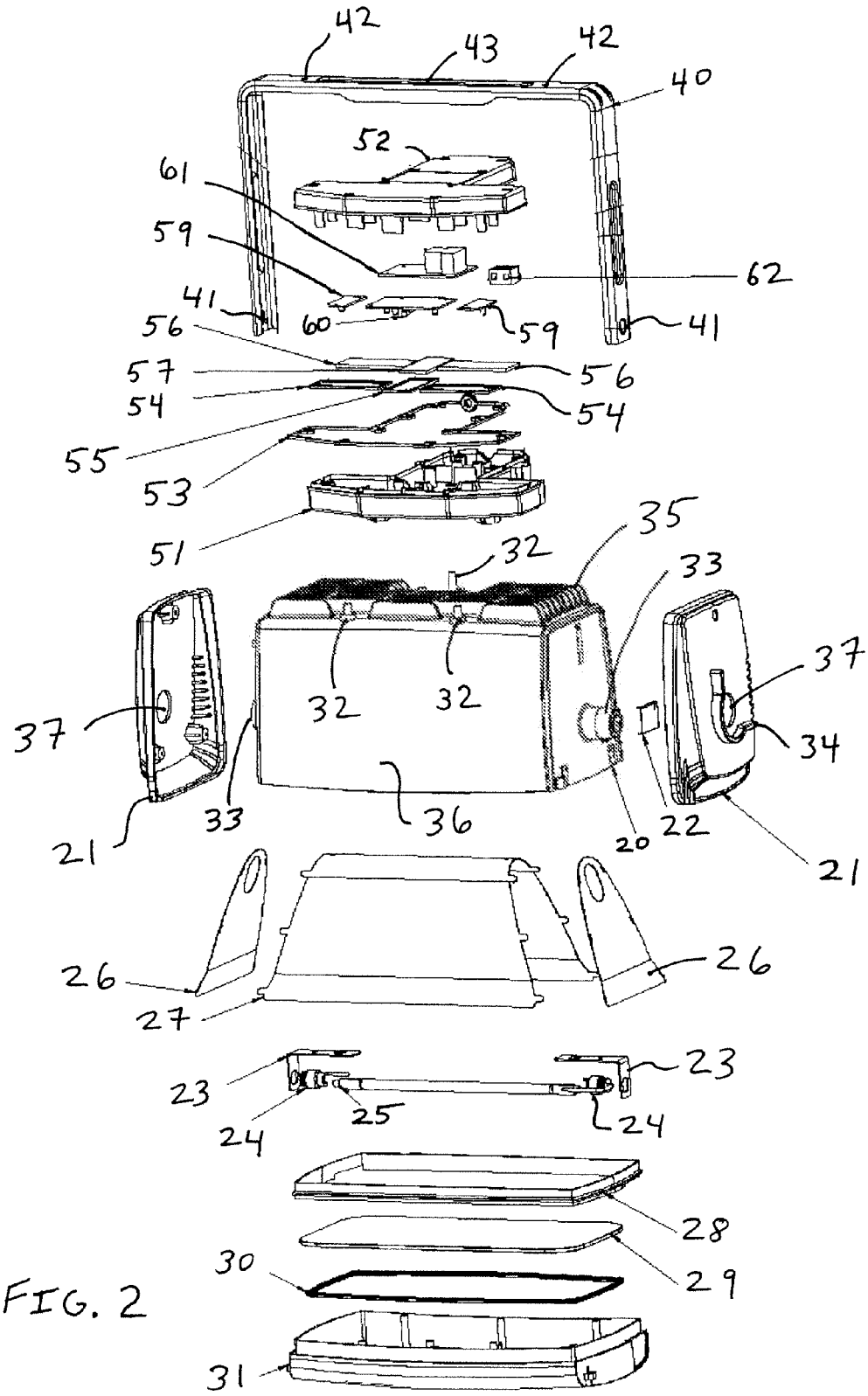
FIG. 2 is an exploded perspective view of the present heater apparatus.

As shown in FIG. 2, main housing 20 is substantially cuboid in shape and includes left and right side covers 21 and two opposing heat shield brackets 22, one of which is shown in FIG. 2. Main housing 20 includes relatively planar top surface 36, rear ventilation grille 35, three rearward facing electronics housing mounting posts 32, and two pivot posts 33, extending outwardly from opposing sides of main housing 20. Left and right side covers 21 each include an associated pivot stop member 34, partially surrounding an associated pivot post aperture 37, through which a pivot post 33 is disposed.

A heat reflector, comprised of main heat reflector 27 and two opposing side heat reflectors 26 is disposed within the interior of main housing 20. Side heat reflectors 26 both include a series of notches proximate their outer periphery, accepting corresponding lugs extending outwardly from two opposing side edges of main heat reflector 27, towards maintaining side heat reflectors 26 adjacent main heat reflector 27.

A heating element, such as halogen heating tube 25, is disposed within the heat reflector and, in turn, within the interior of main housing 20. Spring loaded ceramic terminals 24 permit heating tube 25 to be releasably attached to ceramic terminal mounting bracket 23 and, in turn, to be securely retained within the heat reflector, while permitting removal and replacement of the heating tube.

Tempered glass shield 29 is retained adjacent a corresponding aperture of front cover 31, sandwiched between elastomeric sealing rings 28 and 30. Front cover 31 is preferably attached to main housing 20 in a hinged arrangement, permitting the opening of the main housing to facilitate replacement of the heating tube.

Mounting bracket 40 includes two opposing arms having pivot apertures 41, permitting screws (not shown) to be inserted through pivot apertures 41 and to be threadably received by pivot posts 33 of main housing 20 to, in turn, pivotally attach main housing 20 to mounting bracket 40. Two mounting holes 42, disposed on opposing sides of mounting slot 43 along an elongated arm of mounting bracket 40, permit the mounting bracket and, in turn, the entire heater apparatus, to be affixed to a wall or other vertical surface using conventional fasteners. Stop members 34 cooperate with the arms of mounting bracket 40 to limit pivotal rotation of the mounting bracket to approximately ninety degrees of movement, relative to the mounting bracket, from a substantially horizontally facing position, to a substantially downward facing position, relative to the vertical surface to which the mounting bracket is affixed.

Electronics housing 50 is shown in FIGS. 1 and 2 as comprising front cover 51 having front outer surface 58, back cover 52, main elastomeric ring 53, two outer elastomeric rings 54, outer elastomeric ring 55, two outer tempered glass windows 56, inner tempered glass window 57, two sensor printed circuit boards (PCBs) 59, main PCB 60, power supply PCB 61, and terminal block 62 for connecting power cord power cord 73 to heater apparatus 10. Front cover 51 includes three cylindrical mounting members, each associated with a mounting post 32 of main housing 20, permitting electronics housing 50 to be affixed to main hosing 20, with front outer surface 58 substantially perpendicular to top surface 36 of main housing 36.

As shown in FIG. 1, front cover 51 includes three rectangular apertures. Two outer, horizontal rectangular apertures are each associated with an outer tempered glass window 56 and provide a path for the transmission of infrared signals from an associated sensor PCB 59 to the exterior of heater apparatus 10, proximate top surface 36 of main housing 20. An inner, vertical rectangular aperture is associated with tempered glass window 57, providing an additional path for the transmission of additional infrared signals from main PCB 60, proximate top surface 36, and for the reception of any reflected infrared signals from the exterior of heater apparatus 10 back to main PCB 60.

Figure 3:
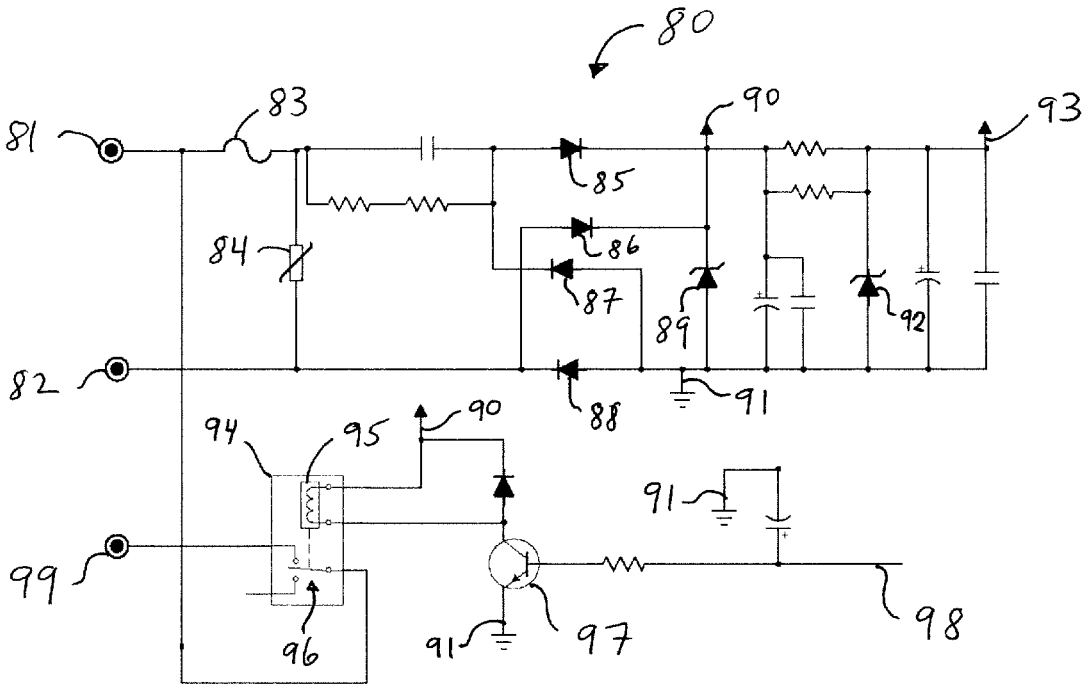
FIG. 3 is a schematic diagram of a portion of the present heater apparatus.
Figure 4:
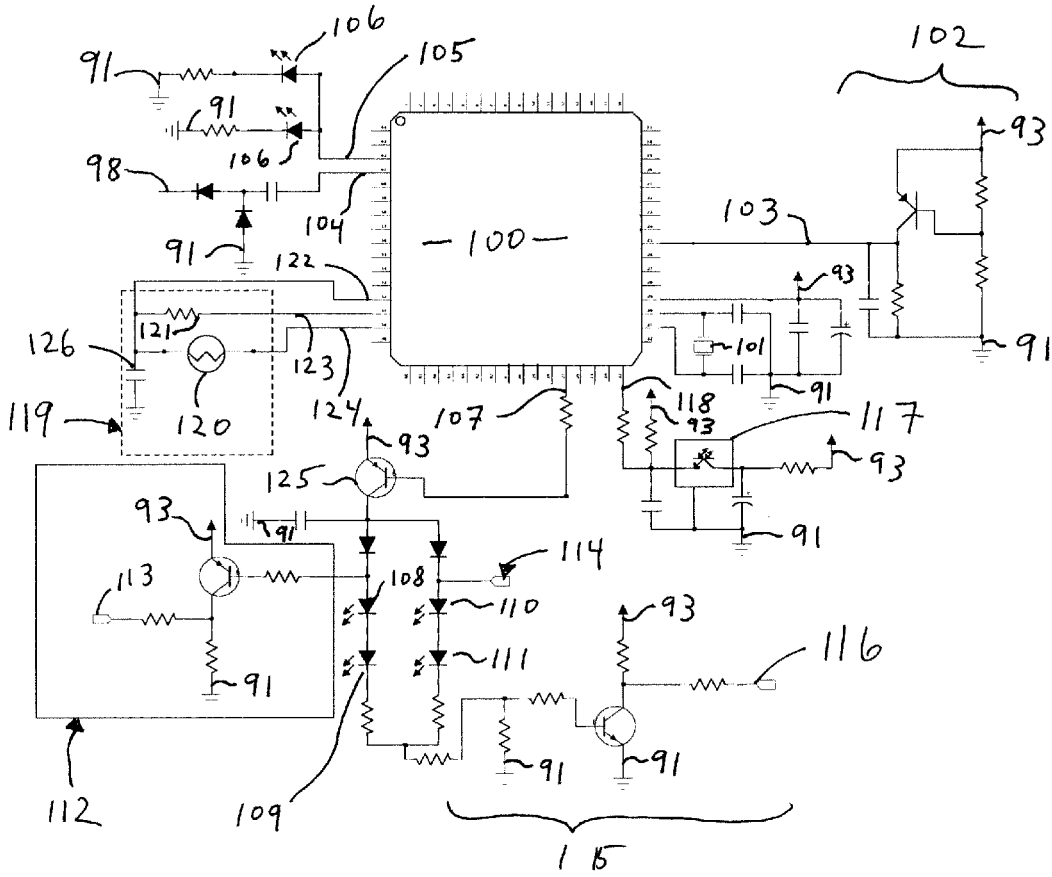
FIG. 4 is a schematic diagram of a portion of the present heater apparatus.

Schematic diagrams of the circuitry contained within electronics housing 50 are shown in FIGS. 3 and 4, with the circuitry of the power supply PCB being shown in FIG. 3, and the sensor and main PCBs being shown in FIG. 4. As shown in FIG. 3, power supply 80 receives an AC line conductor 81 and AC neutral conductor 82 from external power cord 73 (FIG. 1). AC line conductor 81 is coupled to fuse 83 and a switch input portion of normally open SPST relay 94. AC neutral conductor 82 is coupled to varistor 84 and to diodes 88 and 86 which, together with diodes 85 and 87, form a full wave bridge rectifier. The rectified output is coupled to twenty four volt zener diode 89, providing twenty four volt DC power supply 90, relative to ground 91. Five volt zener diode 92 is likewise coupled to the rectified output, providing five volt DC power supply 93, relative to ground 91.

Relay 94 permits AC line conductor 81 to be selectively coupled and decoupled to load 99, which is attached to one end of the heating tube. This, in turn, permits the heating tube to be activated and deactivated, under software control. In particular, when signal 98 is emitted by a microcontroller, transistor 97 is switched on, causing twenty four volt power supply 90 to energize relay coil 95. This, in turn, closes relay switch 96, outputting AC line voltage to load 99 via conductor 81 to, in turn, provide power to the heating tube. When signal 98 is no longer emitted by the microcontroller, transistor 97 is switched off, coil 95 is de-energized, and relay switch 96 returns to its normally open position, removing power from load 99 and, in turn, from the heating tube.

A schematic diagram of the main and sensor PCBs is shown in FIG. 4 as comprising microcontroller 100, having a time base provided by crystal 101. Power-on reset circuitry 102 produces a reset signal 103 whenever the present apparatus is initially connected to AC power, causing microcontroller 100 to perform a hardware reset, followed by system initialization. In a preferred embodiment, microcontroller 100 comprises an 8-bit microcontroller, such as the EM78P468N/L microcontroller manufactured by Elan Microelectronics Corp. Microcontroller 100 includes an on-chip real time clock, watchdog timer, data random access memory, one-time programmable read only memory for program (i.e., firmware) and static data storage, and numerous bi-directional tri-state input/output (I/O) ports. Other microcontrollers or microprocessors may alternatively be used.

A control port 104 of microcontroller 100 emits a signal from which relay control signal 98 is derived, placing the condition, or mode of relay 94 (FIG. 3) and, in turn, the on/off status of the heating tube, under software control. Control port 105 permits microcontroller 100 to turn light emitting diodes (LEDs) 106 on and off. LEDs 106 are visible through an associated aperture or window of the electronics housing and, when blinking in a red color, indicate to the user that a fault condition, resulting in the turning off of the heater tube, has occurred.

Control port 107 permits microcontroller 100 to switch transistor 125 on and off to, in turn, simultaneously power and unpower infrared (IR) emitting diodes 108, 109, 110 and 111. Of these four IR emitting diodes, one is located on a first sensor PCB 59 (FIG. 2), one is located on a second sensor PCB 59, and two are located on opposing sides of main PCB 60. Moreover, each of the IR emitting diodes is disposed immediately behind a tempered glass window of electronics housing 50, (with two IR emitting diodes positioned behind one tempered glass window 56 and the remaining two IR emitting diodes positioned behind the other tempered glass window 56) and proximate top surface 36 of main housing 20, with each IR emitting diode being distally spaced from each other and substantially aligned along a line parallel to top surface 36. In this manner, the four IR emitting diodes collectively provide longitudinal coverage along a substantial length of top surface 36 of main housing 20.

Each IR emitting diode may comprise, for example, an AlGaAs diode in a standard 5 mm diameter package having a clear lens, a typical radiant intensity of approximately 13 mW/Sr, a typical viewing angle of approximately 30 degrees, a typical peak emission wavelength of approximately 940 nm, and a typical spectral line half-width of approximately 60 nm.

As an added safety feature, additional circuitry is provided to enable the microcontroller to test the IR emitting diodes for open circuit and short circuit fault conditions. First IR emitting diode open circuit test circuitry 112 outputs signal 113, coupled to an input port of microcontroller 100. If either IR emitting diode 108 or 109 has failed in an open circuit condition, a logic "0" will be read by the microcontroller input port coupled to signal 113 when transistor 125 is switched on. If a logic "1" is instead read, no open circuit fault has occurred. Second, identical IR emitting diode open circuit test circuitry 114, the construction of which is not shown in FIG. 3 but is identical to that of test circuitry 112, is coupled to IR emitting diodes 110 and 111, and to a separate input port of microprocessor 100. If either IR emitting diode 110 or 111 has failed in an open circuit condition, a logic "0" will be read by microcontroller at this additional input port associated with the output signal of test circuitry 114. If a logic "1" is instead read, no open circuit fault has occurred.

Short circuit test circuitry 115 is also provided. If any of the four infrared emitting diodes have failed in a short circuit condition, a large amount of current will reach the base of the transistor of test circuitry 115 whenever microcontroller 100 switches transistor 125 on. This, in turn, will cause a logic 0 to be output by the test circuitry at signal 116, which is coupled to an input port of microcontroller 100. If a logic "1" is instead read by the microcontroller, no short circuit fault has occurred.

Infrared receiver 117 is also coupled to a dedicated input port 118 of microcontroller 100. Infrared receiver is disposed on main PCB 60, substantially collinear to the IR emitting diodes and substantially centered within electronics housing 50, behind inner tempered glass window 57. In this manner, IR receiver 117 is centrally located and can receive a reflection of the signal output from any of the IR emitting diodes. IR receiver preferably comprises an IR receiver of the type constructed for remote control systems, and combining a positive intrinsic negative diode, limiter, bandpass filter, demodulator, integrator, and comparator, all within one miniature package. In a preferred embodiment, infrared receiver 117 has a typical peak wavelength of approximately 940 nm, a typical bandpass filter center frequency of approximately 37.9 KHz, accepts a high level pulse width of approximately 400 to 800 us, a typical horizontal half angle of approximately 45 degrees, and a typical vertical half angle of approximately 35 degrees.

As shown in FIG. 4, a temperature sensor 119 is also provided. The purpose of the temperature sensor is to determine the temperature of any material falling or otherwise accumulating on top surface 36 of main housing 20. In particular, if snow or ice falls or accumulates on top surface 36 to a sufficient degree to be detected by the IR emitting diodes and IR receiver, operating in conjunction with the microcontroller, it is not desirable to turn off the heating tube. Rather, it is preferably to permit the heating unit to remain in operation, and allow the snow or ice to slowly melt and drip off of the heating unit. The presence of a low ambient temperature proximate top surface 36, in combination with a detected object by the IR emitting diodes and IR receiver, is considered to be indicative of the presence of such ice or snow.

If, however, it is a material other than ice or snow that has fallen or has otherwise come to be present on top surface 36 of main housing 20, such material may potentially be combustible, and it is desirable to turn off the heating element. The presence of an ambient temperature proximate top surface 36 above a predetermined threshold, in combination with a detected object by the IR emitting diodes and IR receiver, is considered to be indicating of the presence of an object other than ice or snow. Accordingly, temperature sensor 119 is preferably placed in close proximity to top surface 36 of main housing 20.

As shown in FIG. 4, temperature sensor 119 includes capacitor 126, a Negative Temperature Coefficient (NTC) thermistor 120, and a precision resistor 121, coupled to input/output ports 122, 123 and 124 of the microcontroller 100. Thermistor 120 is preferably an epoxy sealed NTC thermistor, having an $R_{25}$ rated resistance of approximately 50KΩ+/−3%, and a $B_{25/30}$ material coefficient of approximately 3950KΩ+/=1%. Resistor 121 is preferably a 51KΩ1% precision resistor. Capacitor 126 preferably has a capacitance of 10 NF.

Microcontroller 100 manipulates the input/output states of these ports, and reads the value of these ports in conjunction with an internal timer, in order to determine the temperature being sensed by NTC thermistor 120. In particular, using these I/O ports, microcontroller will first perform a calibration, or reference step, placing precision resistor 121, having a known resistance of R_Reference, in series with capacitor 126 by manipulating the directions of I/O ports 123 and 124 to form a first RC timing circuit. An amount of time TIMER_Reference that it takes for a point between reference resistor 121 and capacitor 126 to reach a predetermined logic threshold voltage, sensed at port 122 is determined. Next, microcontroller 100 places NTC thermistor 120 in series with capacitor 126 by manipulating the directions of I/O ports 123 and 124 to form a second RC timing circuit. An amount of time TIMER_NTC that it takes for a point between NTC thermistor 120 and capacitor 126 to reach a predetermined logic threshold voltage, sensed at port 122, is determined. A resistance value R_NTC corresponding NTC thermistor 120 is then determined by microcontroller 100 by evaluating the following equation:

$$\frac{\text{R_Referemce}}{\text{TIMER_Reference}} = \frac{\text{R_NTC}}{\text{TIMER_NTC}}$$

Next, microcontroller 100 performs a table lookup of a temperature value corresponding to R_NTC resistance, as calculated above. This resistance versus temperature table has been predetermined in advance for a wide range of possible temperature values, and has been prestored in a table within the read-only memory of microcontroller 100.

Figure 5A:
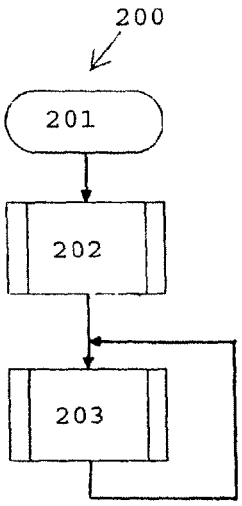
FIG. 5A is a top-level flowchart of certain operations performed by the circuitry and microcontroller firmware of the present heater apparatus.

A top-level flowchart 200 of certain operations performed by the circuitry and microcontroller firmware of the present heater apparatus is shown in FIG. 5A. Upon the initial application of electrical power to the system at step 201, caused by the user plugging in the unit to electrical power (or removing and reapplying the power plug to a source of electrical power), the microcontroller performs system initialization at step 202. As a part of system initialization, an internal timer of the microcontroller is configured to generate a periodic software interrupt every one hundred microseconds (i.e., on the order of ten thousand times per second). Next, at step 203, the microcontroller, repeatedly determines the current ambient temperature proximate the top surface of the main housing, in the manner described immediately above.

Figure 5B:
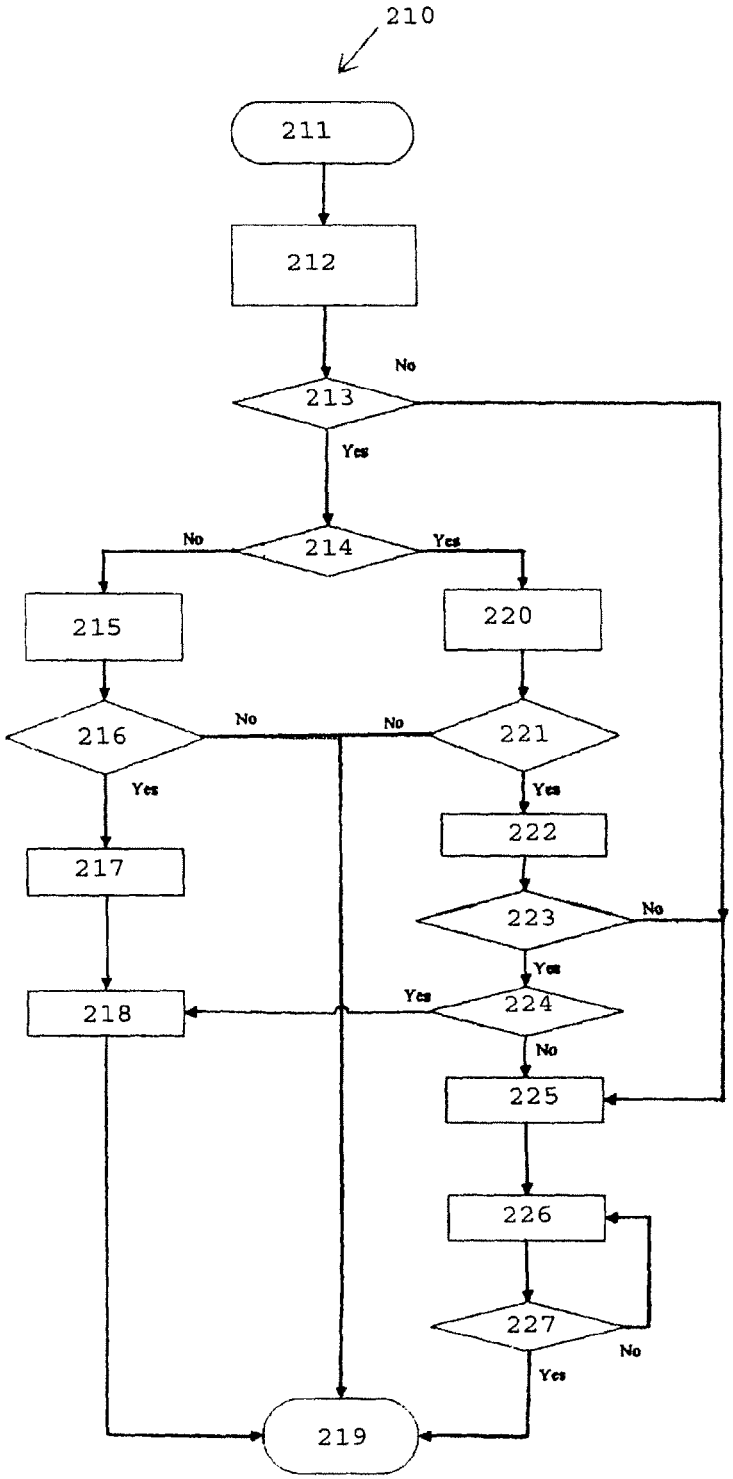
FIG. 5B is a flowchart of certain operations performed by the circuitry and microcontroller firmware of the present heater apparatus in response to a periodic timer interrupt.

A flowchart 210 of certain operations performed by the circuitry and microcontroller firmware of the present heater apparatus in response to a periodic timer interrupt is shown in FIG. 5B. In particular, the steps identified in flowchart 210 are executed ten thousand times per second, in response to the periodic timer interrupt established during system initialization. As shown in FIG. 5A, the timer interrupt is entered at step 211. Next, at step 212, the IR emitting diodes are tested, under the control of the microcontroller, for the presence of either an open circuit short or a closed circuit short fault condition. A test is then made at step 213 to determine if the IR emitting diodes appear to be entirely operational. If not transition is taken to step 225, where the heating element is turned off by de-energizing the normally open SPST relay, removing AC power from the heating element.

If the IR emitting diodes all appear to be operational, transition is taken to step 214, where a test is made to determine if the infrared receiver has received an infrared signal reflected back from one or more of the infrared emitters, indicating that there is debris or other material present on top of the main housing. If an IR signal has not been received, transition is taken to step 215, where a timer or counter within the microcontroller that maintains a determination of how long no IR signal has been consecutively received is maintained. Next, transition is taken to step 216, where a test is made to determine if this timer's value exceeds 300 milliseconds. If not, transition is taken to step 219, and the timer interrupt subprogram is exited. If, however, the timer's value of 300 milliseconds is exceeded, transition is taken to step 217, where the IR emitting diodes are caused to transmit another signal, towards determining, on a subsequent test, whether there is still debris or some other material on top of the main housing of the unit. Transition is then taken to step 218, where the microcontroller emits a control signal which causes the SPST relay to continue to be energized to, in turn, continue to provide AC power to the heating element. Transition is then taken to step 219, where the timer interrupt subprogram is exited.

If an IR signal has been received in step 214, transition is taken to step 220, where a timer or counter within the microcontroller that maintains a determination of how long the IR signal has been contiguously received is updated to reflect an additional 100 microseconds of time.

Next, transition is taken to step 221, where a test is made to determine if this timer or counter has a value greater than or equal to a predetermined value, such as 2,000 milliseconds (i.e., two seconds). Other predetermined values in the range of two to five seconds may alternatively be used. If the timer or counter has not met or exceeded the predetermined threshold, transition is taken to step 219, and the timer interrupt subprogram is exited, to be restarted upon the next occurrence of a timer interrupt.

If, however, this internal timer or counter has met or exceeded a value of two seconds or some other predetermined threshold, transition is taken to step 222, where the IR emitting diodes are caused to transmit another signal, towards determining, on a subsequent test, whether there is still debris or some other material on top of the main housing of the unit. Next, transition is taken to step 223, where the current ambient temperature proximate the top of the man housing of the unit, as determined in step 202 of the main program loop. Initially, a test is made in step 222 to determine if the temperature calculated in the main program loop appears to be a valid, rather than a nonsensical temperature. If not, transition is taken to step 225, where the SPST relay is de-energized in order to remove AC power from the heating element.

Otherwise, transition is taken to step 224, where another test is made to determine if the measured ambient temperature proximate the top surface of the main housing is less than or equal to 1° Celsius (or some other, predetermined temperature), considered to be indicative of the presence of snow or ice, rather than some potentially combustible material. If so, transition is taken to step 218, where the microcontroller emits a control signal which causes the SPST relay to continue to be energized to, in turn, continue to provide AC power to the heating element. Transition is then taken to step 219, where the timer interrupt subprogram is exited.

If, however, in step 224, the ambient temperature is greater than 1° Celsius (or some other, predetermined temperature), transition is taken to step 225, where the SPST relay is de-energized in order to remove AC power from the heating element. Next, in step 226, the two LEDs 106 are simultaneously flashed on and off, providing the user of a visual indication that a fault condition exists and that the heating element is not in operation. Next, in step 227, a test is made to determine if power has been removed from the unit by unplugging it. If not, transition is taken back to step 226, to maintain the flashing of the LEDs. Otherwise, transition is taken to step 219 and the timer interrupt subprogram is exited.

In this manner, one the unit is plugged in, the heating element will remain operational, with AC power being applied to the heating element, unless and until: 1) an open circuit or short circuit fault condition is detected in an IR emitting diode; 2) an invalid ambient temperature is sensed; or 3) an ambient temperature greater than 1° Celsius is sensed proximate the top surface of the main housing, indicating that potentially combustible material has fallen or otherwise come to rest on the surface of the unit, rather than an accumulation of noncombustible ice or snow.

Although, in the embodiment discussed above, IR emitting diodes and an IR receiver are employed, other forms of sensors may alternatively be used. For example, a single ultrasonic transceiver may alternatively be used.

It will be understood that other modifications and variations may likewise be effected without departing from the spirit and scope of the present invention. It will be appreciated that the present disclosure is intended as an exemplification of the invention and is not intended to limit the invention to the specific embodiment illustrated and described. The disclosure is intended to cover, by the appended claims, all such modifications as fall within the scope of the claims.

What is claimed is:

1. An electric heater apparatus, comprising:

a housing having a first surface;

a heating element, at least a portion of the heating element being disposed within the housing;

a proximity sensor associated with the housing, the proximity sensor emitting a signal indicative of a presence of an object proximate the first surface of the housing;

a conductor of electrical power;

a switching device disposed between the conductor of electrical power and the heating element, the switching device having a first mode wherein electrical power is coupled to the heating element and a second mode wherein electrical power is decoupled from the heating element; and a processor operatively coupled to the sensor and the switching device, the processor emitting a signal changing the switching device between the first mode and the second mode in response to the signal emitted by the proximity sensor, wherein the proximity sensor comprises at least one infrared emitting device and an infrared receiving device, and wherein the at least one infrared emitting device comprises a plurality of infrared emitting devices, at least one of the plurality of infrared emitting devices being disposed on a first side of the infrared receiving device and at least another one of the plurality of infrared emitting devices being disposed on a second side of the infrared receiving device.

2. The invention according to claim 1, wherein the proximity sensor comprises an ultrasonic transceiver.

3. The invention according to claim 1, further comprising a temperature sensor associated with the housing, the temperature sensor emitting a signal indicative of ambient temperature proximate the first surface of the housing.

4. An electric heater apparatus, comprising:

a housing having a first surface;

a heating element, at least a portion of the heating element being disposed within the housing;

a proximity sensor associated with the housing, the proximity sensor emitting a signal indicative of a presence of an object proximate the first surface of the housing;

a conductor of electrical power;

a switching device disposed between the conductor of electrical power and the heating element, the switching device having a first mode wherein electrical power is coupled to the heating element and a second mode wherein electrical power is decoupled from the heating element;

a processor operatively coupled to the sensor and the switching device, the processor emitting a signal changing the switching device between the first mode and the second mode in response to the signal emitted by the proximity sensor;

a temperature sensor associated with the housing, the temperature sensor emitting a signal indicative of ambient temperature proximate the first surface of the housing; and means for changing the switching device to the second mode upon both the proximity sensor emitting a signal indicative of a presence of an object proximate the first surface of the housing and the temperature sensor emitting a signal indicative of ambient temperature above a predetermined temperature threshold.

5. The invention according to claim 4, wherein the predetermined temperature threshold is approximately 1° Celsius.

6. The invention according to claim 1, further comprising at least one signaling device operatively coupled to the processor and providing an indication of the switching device transitioning from the first mode to the second mode.

7. The invention according to claim 6, wherein the at least one signaling device comprises at least one light emitting diode.

8. The invention according to claim 1, further comprising a fault detection circuit operatively coupled to the proximity sensor.

9. The invention according to claim 8, wherein the fault detection circuit comprises a short circuit detection circuit.

10. The invention according to claim 9, wherein the fault detection circuit comprises an open circuit detection circuit.

11. A method of operating an electric heater apparatus, comprising the steps of:

(a) obtaining an electric heater apparatus, the electric heater apparatus comprising a housing having a first surface; a heating element, at least a portion of the heating element being disposed within the housing; a proximity sensor associated with the housing, the proximity sensor emitting a signal indicative of a presence of an object proximate the first surface of the housing; a conductor of electrical power; a switching device disposed between the conductor of electrical power and the heating element, the switching device having a first mode wherein electrical power is coupled to the heating element and a second mode wherein electrical power is decoupled from the heating element; and (b) changing the switching device between the first mode and the second mode in response to the signal emitted by the proximity sensor;

wherein the electric heater apparatus further comprises a temperature sensor associated with the housing, the temperature sensor emitting a signal indicative of ambient temperature proximate the first surface of the housing, and where the step of changing the switching device between the first mode and the second mode in response to the signal emitted by the proximity sensor comprises changing the switching device to the second mode upon both the proximity sensor emitting a signal indicative of a presence of an object proximate the first surface of the housing and the temperature sensor emitting a signal indicative of ambient temperature above a predetermined temperature threshold.

12. The method according to claim 11, wherein the predetermined temperature threshold is approximately 1° Celsius.

13. The method according to claim 11, further comprising the step of testing at least a portion of the proximity sensor for a fault condition.

14. The method according to claim 13, wherein the fault condition is an open circuit fault.

15. The method according to claim 13, wherein the fault condition is a short circuit fault.

* * * * *